United States Patent [19]

Wurfel

[11] 4,214,974

[45] Jul. 29, 1980

[54] PROCESS FOR HYDROGENATION OF COAL

[76] Inventor: Helmut Wurfel, Zur Wolfsfels 21, 6653 Blieskastel, Fed. Rep. of Germany

[21] Appl. No.: 941,945

[22] Filed: Sep. 13, 1978

Related U.S. Application Data

[63] Continuation-in-part of Ser. No. 850,204, Nov. 10, 1977, abandoned.

[30] Foreign Application Priority Data

Nov. 10, 1976 [DE] Fed. Rep. of Germany ..... 2651253

[51] Int. Cl.[2] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 2,087,608 | 7/1937 | Pier et al. | 208/10 |
| 2,100,352 | 11/1937 | Pier et al. | 208/10 |
| 3,321,393 | 5/1967 | Schuman et al. | 208/10 |
| 3,488,280 | 1/1970 | Schulman | 208/10 |
| 3,519,554 | 7/1970 | Stotler et al. | 208/10 |
| 3,823,084 | 7/1974 | Schroeder | 208/10 |
| 4,019,975 | 4/1977 | Urquhart | 208/10 |
| 4,097,361 | 6/1978 | Ashworth | 208/10 |
| 4,152,244 | 5/1979 | Raichle et al. | 208/10 |

*Primary Examiner*—Delbert E. Gantz
*Assistant Examiner*—William G. Wright
*Attorney, Agent, or Firm*—James C. Wray

[57] ABSTRACT

The invention is an improvement in the process for hydrogenation of a finely divided coal and oil slurry wherein the improvement comprises subjecting the hydrogenation products to a first phase separation to obtain a liquid fraction and a gaseous fraction. The gaseous fraction is subjected to a second phase separation to obtain a liquid fraction having a boiling range between about 200° C. and about 500° C., which fraction is used to preheat the coal and oil slurry by direct mixing therewith.

11 Claims, 1 Drawing Figure

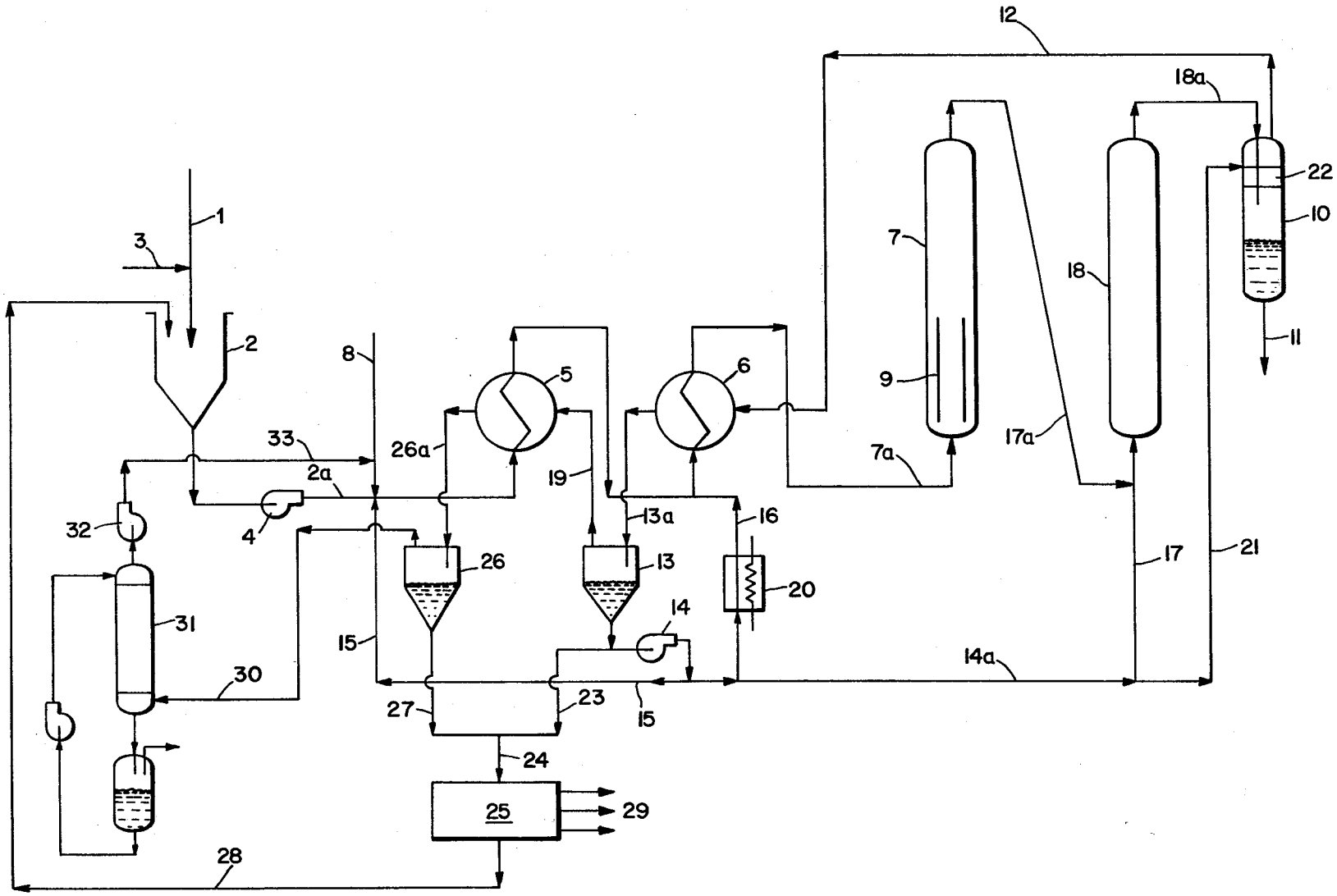
1
2
3
4
5
6
7
7a
8
9
10
11
12
13
13a
14
14a
15
16
17
17a
18
18a
19
20
21
22
23
24
25
26
26a
27
28
29
30
31
32
33
2a

PROCESS FOR HYDROGENATION OF COAL

BACKGROUND OF THE INVENTION

This application is a continuation-in-part for Application Ser. No. 850,204 filed Nov. 10, 1977 now abandoned.

This invention relates to a process for the hydrogenation of coal, wherein finely divided coal is mixed with a hydrocarbon oil to produce a viscous slurry mixture. The mixture is preheated and pumped under pressure into a hydrogenation reactor wherein it is subjected to hydrogenation in the presence of a catalyst and hydrogen. The hydrogenation reaction product is separated into a liquid fraction containing solid substances and a gaseous fraction.

Processes for the hydrogenation of coal are well known in which pulverized coal is mixed with oil to form a viscous suspension which is heat exchanged with a portion of subsequent reaction products, then the suspension is heated to the reaction temperature in a preliminary heater, and subsequently hydrogenated in a reactor to produce oil, naphtha and heavy hydrocarbons. The reaction products leaving the reactor are fractionated into a main fraction comprising gases, naphtha and distillation oils, and a viscous base fraction comprising unreacted coal, ashes, as well as other high molecular weight substances which are difficult to hydrogenize, such as asphaltenes in particular. The main fraction is cooled by heat exchange with the various materials which are being preheated before being added to the reaction zone, and a portion of the base fraction is recycled to the viscous coal slurry before it enters the preheater, which procedure forms a part of a so-called "heat cycle". As a result, a stabilization of temperature is reached and maintained, due to the continuous rapid mixing of the components. The stabilization of temperature is desired because of the strong exothermic reactions involved in the reactor.

A disadvantage of the above process in the recycle of a portion of the base fraction, is the continuous buildup in the reactor of the concentration of substances which are difficult to hydrogenate. Because of the buildup, the heating in the heat exchanger or preheater of the coal and oil slurry flowing into the reactor presents considerable difficulties. Because the coal suspension has a high viscosity, it must be introduced into the outer area of the heat exchanger comprising bundles of pipes during the heat exchange with the main fraction which flows through the pipes. However, from the point of view of heat exchange efficiency in the exchanger, it may be advantageous to introduce the main fraction into the outer area and the slurry through the bundle of pipes. However, such an arrangement is not possible due to the high viscosity of the coal suspension.

In addition to the above disadvantage, the further heating of the coal slurry in the preheater presents difficulties. The coal suspended in the slurry greatly expands in the preheater when subjected to the high temperatures present therein. This results in a further increase in viscosity and a pulsating passage of the coal slurry through the preheater. Accordingly, it is necessary to have strong materials of construction in the preheater, because abrasions and pressure shocks of up to ten bars may be encountered.

The present invention is directed to a process for the hydrogenation of coal wherein the above disadvantages are overcome and there is an improvement in the economics of the process.

SUMMARY OF THE INVENTION

An object of this invention is to provide a process for the hydrogenation of coal, wherein a coal slurry to be hydrogenated is mixed with a recycled fraction of the reaction product to facilitate the flow of the slurry through preheating stages of the process.

Another object of this invention is to provide a process suitable for the hydrogenation of coal and which can also be used to heat oil sands, bitumens, vacuum treated residues, pitch coals, and the like.

Another object of this invention is to provide a process which gives a substantial improvement in the heat exchange between the coal slurry and the hot reaction product fractions.

Another object of this invention is to extensively reduce the swelling and related uncontrollable pulsation undergone by the coal slurry during any preheating stages so as to minimize the loss of pressure and the amount of wear and tear on the corresponding heat exchanger equipment.

Another object of this invention is to provide a process which results in improvement in the stability of the temperatures in the hydrogenation reactor.

For a better understanding of the present invention, together with other and further objects and features thereof, reference is had to the following detailed description of a preferred embodiment taken in connection with the accompanying drawing, the scope of the invention being pointed out in the appended claims.

DETAILED DESCRIPTION OF THE INVENTION

The process of the invention will be better understood by way of example with reference to the accompanying drawing, which is a schematic depiction of the apparatus for carrying out the process.

Coal, in finely divided form, is introduced through feed line 1 along with a hydrocarbon oil through line 3 into a stirred mixing tank 2 wherein the coal and oil are mixed to form a thick coal slurry. Preferably, the ratio of the mixture is about 58–60% by weight coal and about 42–40% by weight oil. The coal slurry leaves the mixer via line 2*a* and is pumped by pump 4 at a pressure of about 220 bar through heat exchangers 5 and 6 wherein the slurry is heated to about 400° C. by heat exchange with recycled hot gas and hydrocarbon fraction and by direct mixing with liquid distillate from lines 15 and 16 as hereinafter more fully described.

The heated slurry exiting heat exchanger 6 is fed through line 7*a* into the first hydrogenation reactor 7. Reactor 7 comprises an internal draft tube 9 comprising two open ends through which the reactor contents and incoming slurry flow in an upward direction and reactor contents also flow downward on the outside of the tube 9. Thus, the inside and outside, opposite upward and downward flow of reactor contents resemble a pumping action whereby hot reactor contents in the upper portion of the reactor are moved downwardly to facilitate mixing with the incoming coal slurry from line 7*a*. As a result, the incoming coal slurry is further heated to an initial hydrogenation temperature of about 430° C. Hydrogen is introduced into the coal slurry and reactor 7 through line 8 and 33 and hydrogenation of the coal slurry takes place in the reactor in the presence of a suitable hydrogenation catalyst at a temperature of about 470° and higher.

Reactor contents including a reaction product fraction are withdrawn from the top of reactor 7 through line 17a and introduced into the bottom of secondary hydrogenation reactor 18 through line 17. A portion of a liquid distillate fraction from a phase separating means 13, to be described hereinafter, is also introduced into reactor 18 through lines 14a and 17. The liquid distillate fraction from separation means 13 has a boiling range between about 200° C. and about 500° C., i.e. similar to medium and heavy hydrocarbons oils. In the reactor 18, a lower boiling gaseous hydrocarbon phase, which may also contain hydrogen and steam, forms a product fraction, and higher boiling hydrocarbons remain in the liquid phase in the reactor.

The gaseous product phase fraction is removed from the top of a secondary reactor 18 through line 18a and introduced into the top of a heat separator 10 wherein a phase separation occurs at a temperature of about 430° C. The separated liquid phase contains solid substances such as unreacted coal, ash, and also under the circumstances particles of catalyst from the hydrogenation reactor. The liquid fraction and solid substances are removed from the bottom of separator 10 through line 11 and introduced into a treatment apparatus (not shown) wherein the oil components in the liquid fraction are separated for reuse in mixing with coal in mixing tank 2.

The gaseous top fraction from heat separator 10 comprises hydrocarbons, hydrogen and steam with an upper boiling point of about 420° C. This gaseous fraction is withdrawn through line 12 and passed through heat exchanger 6, wherein it is cooled in about 370° C. on heat exchange with coal slurry, and this cooling results in partial condensation. From the heat exchanger 6, the gaseous fraction is introduced into phase separator 13 through line 13a wherein a phase separation occurs, resulting in a liquid distillate hydrocarbon fraction having a boiling range between about 200° C. and about 500° C. and preferably between about 280° C. and about 420° C.

The liquid fraction in separator 13 is removed and a portion is pumped by pump 14 through line 15 to be directly mixed with coal slurry entering heat exchanger 5 and through line 16 to be directly mixed with coal slurry entering heat exchanger 6, to further dilute and heat the coal slurry. A second portion of the liquid fraction is passed through lines 14a and 17 into the reactor 18 as described above. A third portion of the liquid fraction is passed through lines 23 and 24 into distillation means 25, wherein various valuable hydrocarbon oils are obtained as product through lines 29.

The gaseous fraction in separator 13 is removed from the top through line 19 and passed through heat exchanger 5 where it undergoes heat exchange with hydrogen and coal slurry from mixing tank 2, after which it is introduced through line 26a into phase separator 26 wherein a phase separation occurs resulting in a hydrogen-containing gas fraction and a liquid base product fraction consisting essentially of medium weight oils, naphtha, and water. The gaseous fraction is passed through line 30 to a gas purifying stage such as a pressurized gas separating tower 31 wherein undesired gases are removed from the gaseous fraction to produce a gas containing mainly hydrogen to be recycled into the system as make-up hydrogen gas by pump 32 through line 33 into line 8. The liquid base product fraction is removed from separator 26 through line 27 and is mixed with liquid product from separator 13 and passed through line 24 into distillation means 25.

The fractions of the coal hydrogenation entering distillation means 25 from lines 23 and 27 are rich in content of naphtha, medium and heavy weight oils and they are obtained as partial fractions and final products through lines 29. Water is also separated in the distillation means. If necessary, a portion of these distillation products as hydrocarbon oils can be recycled through line 28 into the mixing tank 2 for mixture with the finely divided coal.

The products removed through product removal lines 29 and undergo further processing to convert these products into other valuable products such as benzene, heating oil, and the like. It is important that these products be free of undesired impurities in the form of higher boiling components, i.e., asphaltenes, since these will become deposited on the catalyzers in the subsequent hydrogenation reactors. Such impurities can be removed from the products in heat separating means 10, whereby the impurities will not pass to distillation means 25 as part of the base liquid fraction from phase separating means 13. Removal of these impurities in the fraction passing through line 12 from heat separating means 10 can be accomplished by subjection to purification means.

Purification is also accomplished indirectly in separator 10. A portion of liquid fraction from separator 13 is introduced into the upper section of separator 10 through lines 14a and 21 and comes in contact with the gaseous product phase fraction from reactor 18 and the gaseous top fraction leaving separator 10. These gaseous fractions are purified by contact with the higher-boiling components which have been extracted together, particularly asphaltene. The exchange of material is improved by providing a bed of filler compound 22 in the upper section of separator 10. As a result of the exchange, a form of recitification takes place, whereby the liquid fraction introduced through line 21 is partially vaporized and thereby an equivalent portion of the higher-boiling components are condensed in proportion to energy available for the purpose. Asphaltene is washed into the liquid phase fraction of separator 10 as a result of the condensation of the higher boiling component oils. Thus, the purification of the gaseous phase can be accomplished as well as a control of the temperature in separator 10, which is important, because the separator operates effectively only within narrow temperature limits, and therefore it is possible to avoid coking.

The purification process also provides the advantage that the heat obtained from the higher-boiling components on condensation, is returned to the system by steaming of the distillation oils of the liquid fraction entering through line 21, and in thereby heating the coal slurry in exchangers 5 and 6 by the gaseous products from line 12. Accordingly, this enables the temperatures in separator 10 and the separations therein to be varied within broad ranges by changing the quantity of distillation oils entering the purification stage of separator 10 through line 21. It can also be similarly advantageous to introduce into separator 10 a portion of the higher-boiling fraction from phase separator 26 instead of the liquid fraction from phase separator 13, or to introduce a mixture of both fractions from separators 13 and 26.

In accordance with the process of this invention, a substantial portion of the excess exothermic heat produced in the hydrogenation reactor 7 can be brought back into the system, thereby eliminating the need of an expensive, energy consuming preheater. In order to facilitate and initially establish the necessary hydrogenation temperature in reactor 7, a heat exchanger 20, heated with external heat, is provided to increase the temperature of the liquid distillate from separator 13 in line 16 combining with the coal slurry from heat exchanger 5 prior to passage through heat exchanger 6. This additional heating of the liquid distillate, contrasted with the required prior art heating of the coal slurry in a preheater has the additional advantage that the tendency for coking is substantially less.

In addition, the process of the invention has another advantage in that substantial amounts of hydrogen are dissolved in the liquid phase of separator 13. This hydrogen is accordingly simply recycled to the reactor 18 with the liquid distillate in line 16 mixed with the coal slurry.

The present invention is not restricted to the embodiment illustrated, but is understood to embody within the scope of the patent warranted hereon, all such embodiments as reasonably and properly come within the scope of my contribution to the art.

What is claimed is:

1. In a process for the hydrogenation of coal wherein a finely divided coal-oil slurry is pumped under pressure through preheating means and into a hydrogenation reactor wherein the slurry is hydrogenated in the presence of hydrogen and a hydrogenation catalyst, the improvement which comprises subjecting the hydrogenation products from said reactor to a first phase separation to obtain a first liquid fraction and a first gaseous fraction, separating from said first gaseous fraction a second liquid fraction at an elevated temperature having a boiling range between about 200° C. and about 500° C., and preheating said slurry by directly mixing at least a portion of said second liquid fraction with said slurry under pressure.

2. The process of claim 1 wherein said second liquid fraction is obtained by partial condensation of said first gaseous fraction and subjecting said partially condensed first gaseous fraction to a second phase separation to obtain said second liquid fraction.

3. The process of claim 1 wherein a second portion of said second liquid fraction is added to said reactor.

4. The process of claim 1 wherein said second liquid fraction has a boiling range between about 280° C. and about 420° C.

5. The process of claim 1 wherein a second gaseous fraction is obtained during the separation of said second liquid fraction from said first gaseous fraction, and said second gaseous fraction is partially condensed by indirect heat exchange with said slurry, subjected to a third phase separation to obtain a hydrogen-rich gaseous fraction which is purified and mixed with said slurry and hydrogen from an external source.

6. The process of claim 1 wherein said second liquid fraction directly mixed with said slurry is preheated by an external heat source.

7. The process of claim 1 wherein said first phase separation comprises purification of said hydrogenation products to remove undesired higher boiling components.

8. The process of claim 2 wherein said partial condensation is conducted by indirect heat exchange of said first gaseous fraction with said slurry prior to its being pumped into said reactor.

9. The process of claim 3 wherein the amount of said second liquid fraction added to said reactor is determined by the temperature inside said reactor.

10. The process of claim 7 wherein said purification is conducted during said first phase separation by contact of said hydrogenation products with a portion of said second liquid fraction.

11. The process of claim 10 wherein said purification is conducted in a bed of filler material.

* * * * *